United States Patent [19]

Schutt

[11] 4,003,361

[45] Jan. 18, 1977

[54] FIREPLACE ASSEMBLY WITH VARIABLE APPEARANCE

[76] Inventor: Keith M. Schutt, 1330 E. Rand Road, Des Plaines, Ill. 60016

[22] Filed: Apr. 5, 1974

[21] Appl. No.: 458,082

[52] U.S. Cl. ..... 126/120; 126/139; D23/97

[51] Int. Cl.[2] ..... F24B 1/18

[58] Field of Search ..... 126/120, 138, 139, 121, 126/216, 332; D23/97, 94, 95, 96; 52/36; D13/5

[56] References Cited

UNITED STATES PATENTS

| | | | |
|---|---|---|---|
| 2,768,042 | 10/1956 | Persinger et al. | 126/332 X |
| 2,772,414 | 11/1956 | Baker, Jr. | 126/216 X |
| 2,796,858 | 6/1957 | Carpenter | 126/62 |
| 3,169,516 | 2/1965 | Agnese | 126/121 X |
| 3,190,279 | 6/1965 | Davis | 126/121 X |
| 3,830,217 | 6/1972 | Maness et al. | 126/120 |
| D212,948 | 12/1968 | Toerge et al. | 23/97 |

FOREIGN PATENTS OR APPLICATIONS

| | | | |
|---|---|---|---|
| 799,334 | 6/1936 | France | 126/216 |

*Primary Examiner*—William F. O'Dea
*Assistant Examiner*—Harold Joyce
*Attorney, Agent, or Firm*—Alan M. Abrams

[57] ABSTRACT

Free standing fire place assemblies having an interchangeable mantel member adapted for mating with a fire box member for achieving different design configurations.

5 Claims, 6 Drawing Figures

FIG. 1
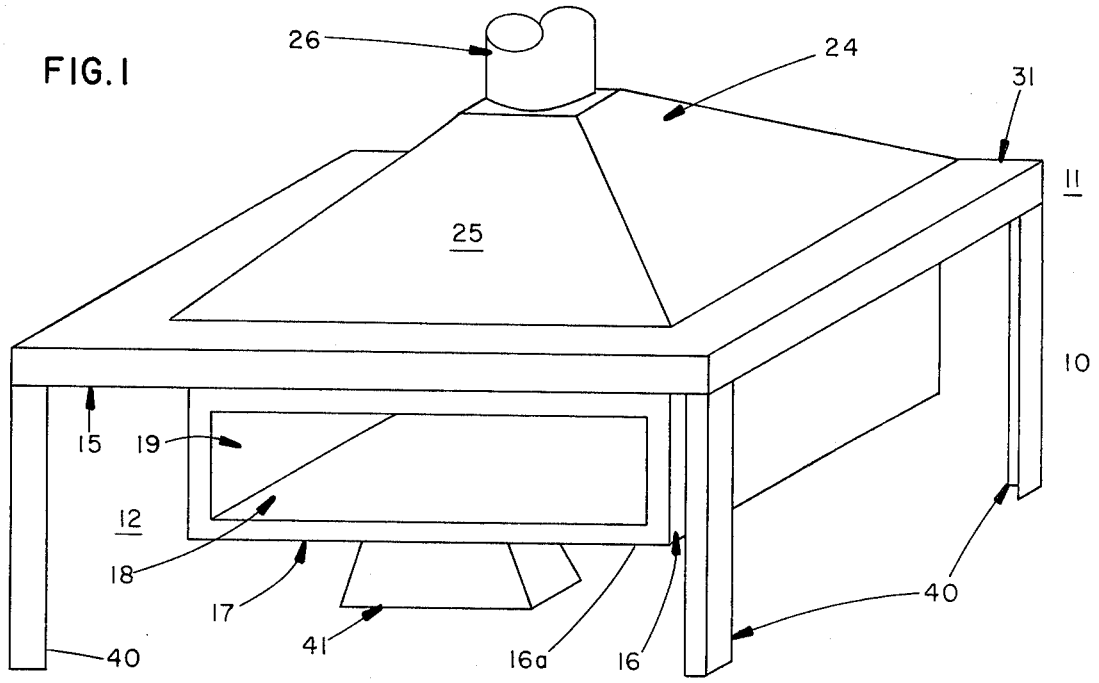
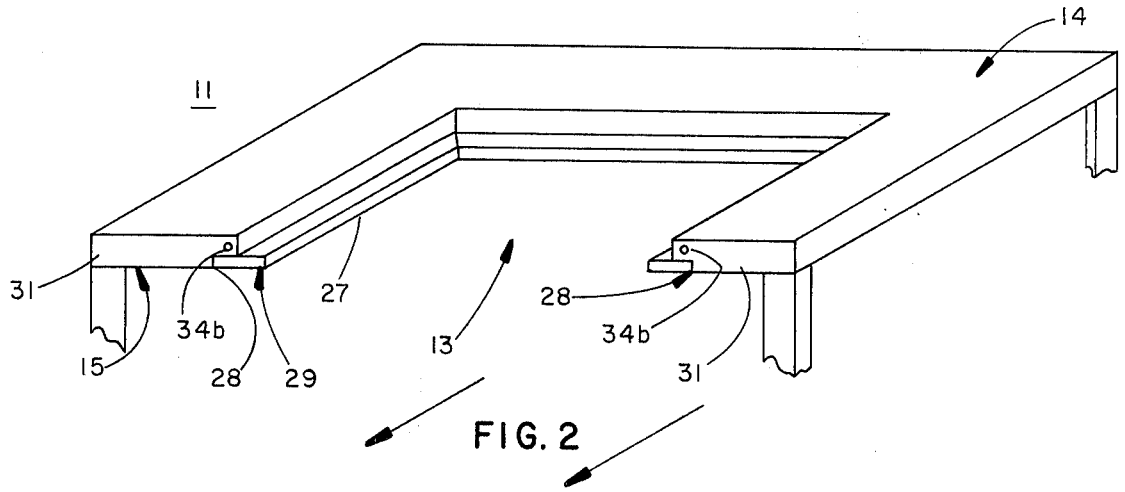
FIG. 2
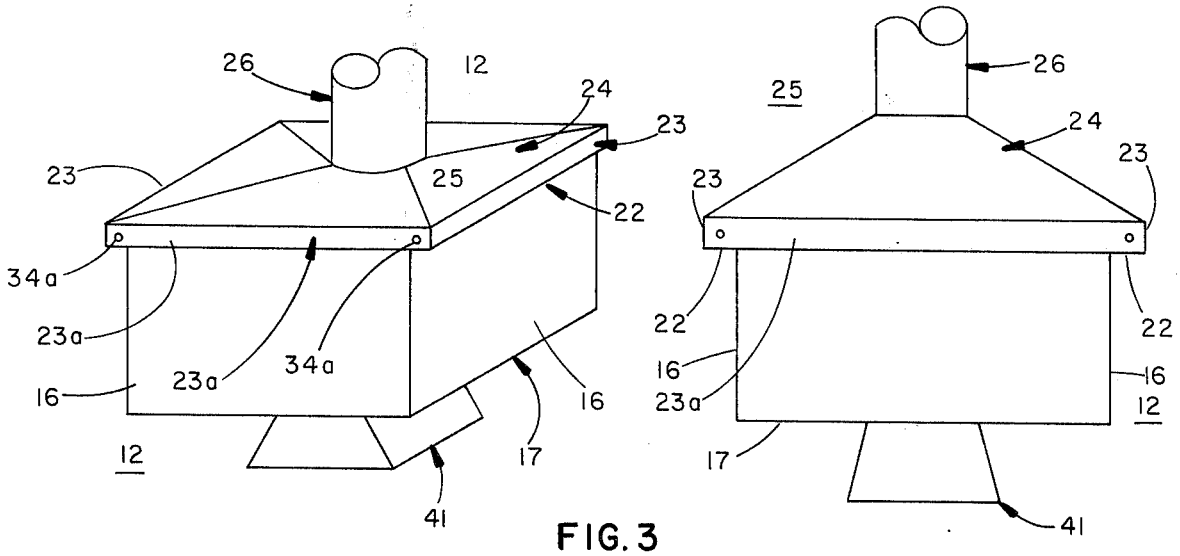
FIG. 3

FIRE PLACE ASSEMBLY WITH VARIABLE APPEARANCE

This invention relates to a fire place assembly and more particularly to a free standing fire place assembly having an interchangeable mantel which may have a variety of different configurations so as to readily provide a fire place assembly having different design appearances.

Free standing fire place assemblies, that is fire places capable of standing apart from or independent of any supporting wall structure, have gained wide acceptance recently because of their ease of installation and pleasing design appearance which greatly compliment the decor and furniture arrangement of interior room arrangements.

One limitation affecting the even wider utilization of these free standing fire place assemblies is that the typical assembly is fabricated basically from a fire box member of generally a unitary or singular design configuration which substantially restricts the availability of different designs for such assemblies. While the fire box member may and often is integrally associated with a few minor design variations such as a different mantel or other associated decor to modify the design somewhat, the limited basic design of the fire box member effectively restricts the assembly to a few different, overall furniture designs. Thus it is often quite difficult to obtain a free standing fire place which will esthetically harmonize with a particular room and furniture decor. Moreover, even after the original selection of a desirable design, the change of even the furniture style within a room setting will often result in a styling clash with the original fire place assembly.

It has now been discovered, however, that free standing fire place assemblies having an infinite variety of design configurations may be readily and easily obtained even when employing one basic fire box design through the employment of an interchangeable mantel member which is capable of being arranged in an infinite variety of different designs. This allows a quick modification of the fire place assembly through an interchange with a different mantel member having a different design configuration so as to immediately adapt the overall design of the assembly for any particular room decor.

Accordingly an object of this invention is to provide a free standing fire place assembly capable of being readily modified to achieve a variety of different design configurations. Another object is to provide such assembly with an interchangeable mantel member whereby mantel members having a variety of different design configurations may be readily interchanged and joined with one basic fire box member so as to provide assemblies having an infinite variety of different design configurations. A further object is to provide a simple and ready means of joining an interchangeable mantel member with a fire box member so as to create a unitary free standing fire place assembly. These and other objects of the invention will be readily apparent from the following further detailed description thereof as well as from the accompanying drawings.

IN THE DRAWINGS

FIG. 1 is a perspective view of a free standing fire place assembly according to this invention.

FIG. 2 is a perspective view from the rear with the mantel member detached from the fire box member of the assembly of FIG. 1.

FIG. 3 is a rear elevation of the fire box member of FIG. 2.

Figure 4:
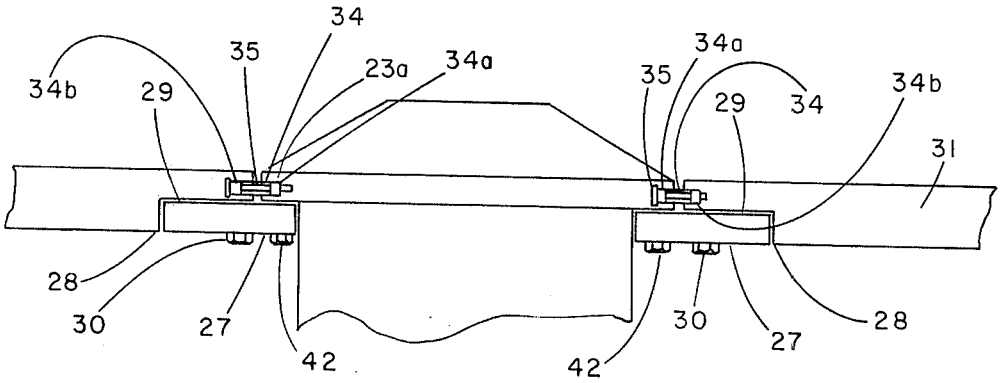
FIG. 4 is an enlarged, rear elevation of the assembly of FIG. 1.

Referring to the drawing, the present invention comprises a free standing fire place assembly 10 which is composed basically of a mantel member 11 which is adapted for mating or joining with a fire box member 12. As illustrated, especially in FIG. 2, the mantel member 11 is generally of a slab-like configuration and has an opening or slot 13 which extends vertically from the top surface 14 to the bottom surface 15 of the mantel member 11. This slot 13 is adapted for junction or mating with a mating portion of the fire box member 12.

The fire box member 12 in a specific embodiment basically comprises generally downwardly extending and interconnected side closure panels 16 which are joined together at a lower portion thereof with a bottom closure panel 17 so as to define there between an internal fire chamber 18 bounded by side and bottom closure panels 16 and 17, respectively. One of such side panels 16 or front panel 16a conveniently has an opening 19 which provides the customary access to the fire chamber 18 for adding fuel or fire wood (not shown) and for initiating and controlling the fire.

In a preferred embodiment the fire box member 12 has a shelf extension 22 best illustrated in FIGS. 2 and 3 which extends generally horizontally outwardly from the closure panels 16 and extends continuously around the upper perimeter of the fire box member 12. This shelf extension 22 is adapted as the mating portion so as to join with the mantel member 11 by receipt into the slot 13 such as by a sliding action illustrated best in FIG. 2 by the arrows. This shelf extension 22 generally has an upwardly and vertical extending skirt 23 which in a preferred embodiment, together with a horizontal top cover 24, forms a hood 25 which encloses the upper portion of the fire box member 12. Such hood 25 is in fluid communication with an upwardly extending stove pipe 26 centrally joined with top cover 24 which in conventional operation carries the uprising smoke from the fire chamber 18 to the external atmosphere.

In simplest operation and as best illustrated by reference to FIG. 2, the interchangeable mantel member 11 is readily joined with the fire box member 12 by moving the mantel member 11 into a mating relationship with the fire box member 12 and specifically by bringing the shelf extension 22 into registry with the slot 13 and then moving the mantel member 11 so that the shelf extension 22 is positioned within the slot 13.

In order to provide the desired support and mating relationship of the mantel member 11 and the fire box member 12, the mantel member 11 is advantageously equipped with a supporting collar 27. This collar 27 is positioned on the bottom surface 15 of the mantel member 11 and extends inwardly and about the perimeter of the slot 13. Preferably, the collar 27 is positioned or housed within a groove 28 formed within the lower surface 15 of the mantel member 11 and adjacent to the slot 13. The dimensions of the groove 28 and the collar 27 are so arranged that the collar 27 extends into the groove 28 and when so extended, the bottom surface 29 of the collar 27 is flush with the bottom surface 15 of the mantel member 11. The collar 27 is joined with the mantel member 11 suitably by appropriate fastening means such as screws 30 best illustrated in FIG. 5 which extend upwardly through the collar 27 and are locked within the mantel member 11.

In joining the mantel member 11 and the fire box member 12 the shelf extension 22 guides over the collar 27 and when the members are properly mated rests upon such collar 27. Suitably the upwardly extending skirt 23 of the shelf extension 22 is adapted so that it is of the equivalent vertical height of the slot 13 above the extension 22 so that when the mantel member 11 and fire box 12 are mated the hood 25, defined by the shelf extension 22 and skirt 23, substantially conforms to the dimensions of the slot 13.

Figure 5:
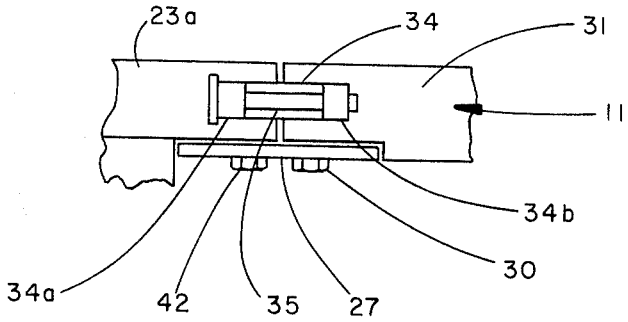
FIG. 5 is an exploded partial view of FIG. 4 illustrating the joining means for the fire box member and the mantel member.

So as to firmly lock the mantel member 11 and the fire box member 12 together when joined as a unitary assembly a number of different locking means may be suitably employed. One particular arrangement, as illustrated in FIG. 5, is to position co-acting elements of locking members on the rear portion 23*a* of the skirt 23 and on the rear vertical wall 31 of the mantel member 11. Suitable locking means are illustrated as latches 34 having co-acting elements 34*a* and 34*b*. Thus when the mantel member 11 and fire box member 12 are joined together bolts 35 may be readily and easily inserted through the co-acting elements 34*a* and 34*b* to firmly interconnect the mantel member 11 and fire box member 12 in a firm locking arrangement.

Figure 6:
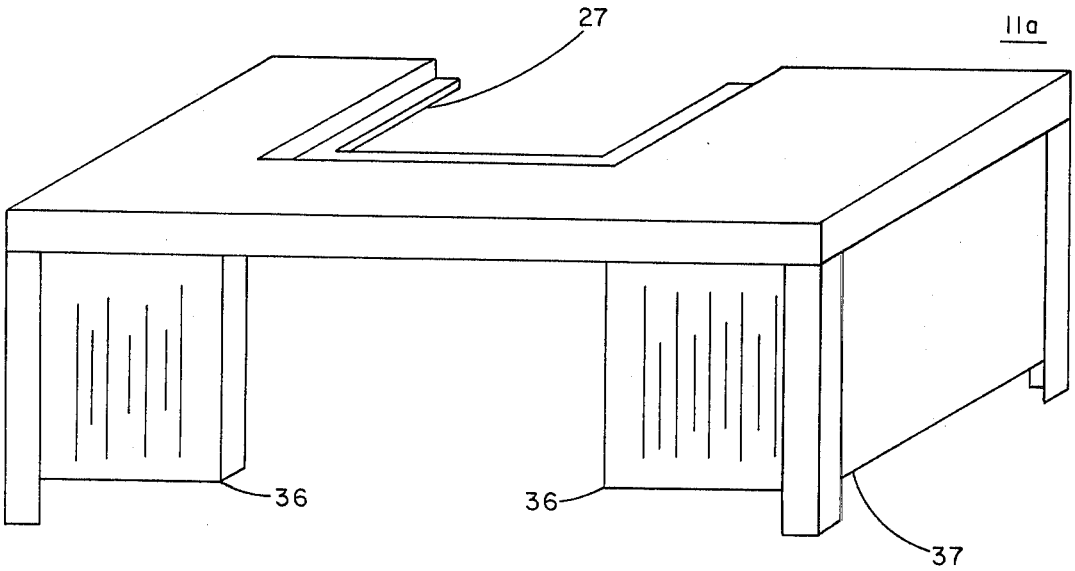
FIG. 6 is a front perspective view of an alternate, interchangeable mantel member.

As discussed previously, one of the unique advantages of the free standing fire place assembly of this invention is that an infinite variety of configurations or appearances may be readily and easily achieved for the assembly through employment of the interchangeable mantel member 11. For example as illustrated in FIG. 6 an alternative mantel member 11*a* is shown which may be freely interchanged with the mantel member 11 so as to create an entirely different appearance and decor for the assembly illustrated in FIG. 1. For example panels 36 may be added as well as side rails 37 so as to radically change the decor of the assembly 10 to match any particular room of furniture decor simply through employment of such different mantel member.

Employment of such interchangeable mantel member also permits a variety of other modifications to change the overall appearance of the free standing fire place assembly. For example, as illustrated in FIG. 1 the mantel member 11 is joined with support means such as legs 40 which extend downwardly and rest upon a bearing surface such as a floor (not shown). These legs 40 may be omitted entirely and the support for the mantel member 11 and fire box member 12 may be supplied by a base means such as pedestal 41 which extends downwardly from the fire box member 12 and rests upon a bearing surface or floor (not shown). As a further modification the pedestal 41 may be omitted and the mantel member 11 with the legs 40 employed to support the fire box member 12.

To provide an additional interlocking arrangement for the mantel member 11 and the firebox member 12 beyond the latches 34 and particularly to allow for additional design variations, it is generally desirable to interconnect the collar 27 and the shelf extension 22 such as by upward extending fastening means such as bolts 42 as illustrated in FIGS. 4 and 5. This is particularly desirable when the support means such as the legs 40 are omitted from the mantel member 11. Thus the bolts 42 will serve to hold the mantel member 11 in a supporting arrangement without such legs 40 thereby achieving even further design versatility.

The mantel member 11 and fire box member 12 can, of course, be made of a variety of conventional materials suitably employed for free standing fire places. Moreover these members may be fabricated in accordance with any of the conventional fabrication techniques currently employed and in this respect the mantel member 11 and fire box member 12 have been described herein in the simplest and briefest fashion for ease of description and illustration. It is accordingly intended that any structural arrangement for the mantel member 11 and fire box member 12 may be employed and remain within the scope of this invention. For example, the hood 25 may be arranged so as to achieve a variety of different design configurations and may additionally comprise different joining methods for the shelf extension 22 and skirt 23 and yet remain within the scope of this invention.

Furthermore, the slot 13 which is generally shown in the figures in a simple embodiment as having a rectangular, transverse cross-section can be arranged so as to have a V or curved transverse cross-section to obtain different design arrangements for the assembly. This, of course, will be associated with a corresponding change in the transverse cross-section of the fire box member 12 so that the fire box member 12 and particularly the shelf extension 22 will mate within the slot 13 having these different cross-section configurations.

In the above description of the invention it should be understood that the preferred embodiments were described for purposes of illustration and description only. Description of these preferred embodiments is not intended, however, to limit the invention to the precise form or arrangement shown and discussed. These embodiments were chosen in order to conveniently explain the principles of the invention and their application and practical use so as to enable those skilled in the art to utilize the invention in various embodiments and modifications as are best adapted to the particular use contemplated.

I claim:

1. A free standing fire place assembly of a mantel member and a fire box member said mantel member being adapted for joining with the fire box member and interchangeable with mantel members of different design configurations whereby different mantel members may be interchangeably joined with one fire box member to create a variety of different appearances for the assembly, wherein the mantel member comprises a slab-like configuration having a slot which extends through the mantel member from the top surface to the bottom surface and opens to the rear of the mantel member and which receives a mating portion of the fire box member and thereby locks the fire box member and mantel member together as a unitary assembly and wherein the fire box member comprises downwardly extending, interconnected closure panels joined together at a lower portion thereof by a bottom closure panel to define an interior fire chamber and which has a shelf extension at the upper portion thereof extending horizontally outwardly from and around the perimeter of the fire box member said shelf extension being the mating portion received by sliding action into and within the slot of the mantel member said mantel member having a supporting collar positioned at a lower position of the slot and extending horizontally inwardly and about the perimeter of the slot and housed within an open groove formed within the bottom surface of the mantel member and adjacent and about the slot, said groove having a depth sufficient so that the bottom surface of the collar member is flush with the adjacent bottom surface of the mantel member wherein the shelf extension of the fire box slidably rests upon the supporting collar of the mantel member in a supporting arrangement when the mantel member and fire box member are joined together as a unitary assembly, said mantel member is joined with support means which extend downwardly from the mantel member and rest upon a bearing surface so as to support both the mantel member and the fire box member when joined therewith as a unitary assembly.

2. The assembly of claim 1 wherein the shelf extension is joined integrally with a hood which encloses the upper portion of the fire box member and is in fluid communication with a stove pipe for carrying smoke from the interior of the fire box member to the external atmosphere.

3. The assembly of claim 1 wherein the fire box member is joined at its lower portion with a base means which extends downwardly and rests upon a bearing surface, said base means supporting the fire box member and the mantel member when such members are joined together as a unitary assembly.

4. The assembly of claim 1 wherein the mantel member and the fire box member each bear a co-acting element of a locking means which may be actuated when such members are joined together as a unitary assembly whereby such members are securely locked together.

5. The assembly of claim 4 wherein the shelf extension of the fire box member has a first set of latching members mounted on the rear portion of its perimeter which mates with the rear vertical surface of the mantel member and wherein there is a second and corresponding set of latching members positioned on the rear surface of the mantel member which second set is in registry with the first set when the shelf extension is positioned within the slot of the mantel member so that associated pin members may be inserted through each set of registered latching members and thus firmly lock the fire box member and mantel member together as a unitary assembly.

* * * * *